US011981984B2

(12) United States Patent
Toyoda et al.

(10) Patent No.: US 11,981,984 B2
(45) Date of Patent: May 14, 2024

(54) HOT ROLLED STEEL SHEET

(71) Applicant: NIPPON STEEL CORPORATION, Tokyo (JP)

(72) Inventors: Takeshi Toyoda, Tokyo (JP); Eisaku Sakurada, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 4 days.

(21) Appl. No.: 18/009,852

(22) PCT Filed: Aug. 10, 2021

(86) PCT No.: PCT/JP2021/029553

§ 371 (c)(1),
(2) Date: Dec. 12, 2022

(87) PCT Pub. No.: WO2022/070621

PCT Pub. Date: Apr. 7, 2022

(65) Prior Publication Data

US 2023/0265548 A1 Aug. 24, 2023

(30) Foreign Application Priority Data

Sep. 29, 2020 (JP) ..... 2020-163474

(51) Int. Cl.

| | |
|---|---|
| ***C22C 38/54*** | (2006.01) |
| ***C21D 6/00*** | (2006.01) |
| ***C21D 8/02*** | (2006.01) |
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |

(52) U.S. Cl.

CPC ..... *C22C 38/54* (2013.01); *C21D 6/004* (2013.01); *C21D 6/005* (2013.01); *C21D 6/008* (2013.01); *C21D 8/0226* (2013.01); *C21D 9/46* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C21D 2211/002* (2013.01); *C21D 2211/005* (2013.01); *C21D 2211/008* (2013.01)

(58) Field of Classification Search

CPC ..... C22C 38/02; C22C 38/04

See application file for complete search history.

(56) References Cited

U.S. PATENT DOCUMENTS

2014/0305550 A1 10/2014 Ariga et al.

FOREIGN PATENT DOCUMENTS

| | | | |
|---|---|---|---|
| JP | 10-46258 | A | 2/1998 |
| JP | 2002-121646 | A | 4/2002 |
| JP | 2004-197114 | A | 7/2004 |
| JP | 2004-225109 | A | 8/2004 |
| JP | 2012-172257 | A | 9/2012 |
| JP | 2015-4081 | A | 1/2015 |
| WO | WO 2013/069251 | A1 | 5/2013 |

*Primary Examiner* — Adam Krupicka

(74) *Attorney, Agent, or Firm* — Birch, Stewart, Kolasch & Birch, LLP

(57) ABSTRACT

Provided is a hot rolled steel sheet having a tensile strength of 780 MPa or more, a sheet thickness of 1.2 to 4.0 mm, and a sheet width of 750 mm or more, and satisfying $-15 \leq (\lambda_{W1}+\lambda_{W2})/2-\lambda_C \leq 15$ (where $\lambda_{W1}$ and $\lambda_{W2}$ respectively indicate hole expansion ratios (%) at ⅛ positions of the sheet width from one end of the hot rolled steel sheet in a sheet width direction perpendicular to a rolling direction and the other end at an opposite side, and $\lambda_C$ indicates a hole expansion ratio (%) of a sheet width center part).

7 Claims, No Drawings

HOT ROLLED STEEL SHEET

FIELD

The present invention relates to a hot rolled steel sheet.

BACKGROUND

If making steel sheet high in strength, generally the workability falls, therefore trying to achieve both strength and workability in steel sheet is generally difficult. In addition, for example, if working steel sheet into a complicated shape part, etc., is demanded, if the characteristics are not uniform in the sheet width direction of the steel sheet, sometimes the portion of steel sheet which can be applied to the part will be limited. For this reason, from the viewpoint of the yield as well, the characteristics are preferably uniform in the sheet width direction of the steel sheet.

In relation to this, for example, PTL 1 describes high yield ratio high strength hot rolled steel sheet having a steel composition containing, by mass %, C: 0.05% or more and 0.2% or less, Si: 0.01% or more and 0.6% or less, Mn: 0.5% or more and 2.5% or less, P: 0.001% or more and 0.1% or less, S: 0.0005% or more and 0.05% or less, Al: 0.01% or more and 0.2% or less, N: 0.0001% or more and 0.010% or less, Mo: 0.05% or more and 0.5% or less, Ti: 48N/14+0.01% or more and 0.14% or less, and B: 0.0003% or more and 0.005% or less in a range satisfying the formula 70≤300×C (mass %)+33×Mn (mass %)+22×Cr (mass %)+11×Mo (mass %)+11×Si (mass %)+17×Ni (mass %)≤100 and having a balance of iron and unavoidable impurities, wherein the yield strength is 960 MPa or more, the yield ratio is 0.83 or more, and the variation in yield strength in the sheet width direction is within 50 MPa. Further, PTL 1 describes that due to the above configuration, it is possible to obtain high yield ratio high strength steel sheet with little variation in strength in the sheet width direction and excellent in toughness with a yield strength of 960 MPa or more and a yield ratio of 0.83 or more.

PTL 2 describes a method of production of Ti-containing high strength hot rolled steel sheet with little variation in strength between steel sheets by loading a slab produced by continuous casting and containing, by wt %, C: 0.05 to 0.12%, N: 0.001 to 0.005%, and Ti: 0.04 to 0.15% into a heating furnace and heating it, holding it at a TiC solid solution temperature T (K) or more under conditions of a holding time "t" (hours) satisfying the formula T·(10+log t)≥15000, and extracting it from the heating furnace and rolling it. Further, PTL 2 describes that it is possible to suppress a variation in strength of steel sheet due to insufficient dissolution of Ti by quantification of the heating conditions for sufficiently dissolving the added Ti, that there is no longer almost any deviation from the strength specifications, and that there is no longer steel sheet failing to meet the grade.

PTL 3 describes high strength hot rolled steel sheet having steel constituents containing, by mass %, C: 0.020 to 0.065%, Si: 0.1% or less, Mn: 0.40 to less than 0.80%, P: 0.030% or less, S: 0.005% or less, Ti: 0.08 to 0.20%, Al: 0.005 to 0.1%, and N: 0.005% or less, having a balance of Fe and unavoidable impurities, and having Ti* defined by the formula Ti*=Ti−(48/14)×N satisfying a predetermined formula, wherein the steel structure comprises, by area ratio, 95% or more of a ferrite phase and a balance of one or more phases of a pearlite phase, bainite phase, and martensite phase, an average ferrite grain size of the ferrite is 10 μm or less, an average particle size of Ti carbides precipitating in the steel is 10 nm or less, and Ti of 80% or more of Ti* precipitates as Ti carbides. Further, PTL 3 describes that, due to the above configuration, high strength hot rolled steel sheet high in strength, excellent in ductility and stretch flangeability, and having excellent uniformity of quality with little variation in strength in the steel sheet, more specifically high strength hot rolled steel sheet having a variation ΔTS of tensile strength (TS) of 15 MPa or less, is obtained.

PTL 4 describes high workability high strength hot rolled steel sheet with little variation in quality in a coil having a chemical composition substantially containing C: 0.05 to 0.18 mass %, Si: 0.7 to 1.5 mass %, Mn: 0.6 to 1.8 mass %, P: 0.04 mass % or less, S: 0.005 mass % or less, Al: 0.01 to 0.10 mass %, N: 0.005 mass % or less, and Mo: 0.05 to 1.5 mass % and having a balance of Fe. Further, PTL 4 describes that the above hot rolled steel sheet is uniform in quality across the entire length and entire width of the coil and that variation in the coil quality is suitably kept down.

PTL 5 describes high strength hot rolled steel sheet with a tensile strength of 980 MPa or more having a chemical composition satisfying formula 0.25<Ti+V to 0.45 and having dissolved V: 0.05% or more and less than 0.15% and having a structure comprised of a matrix with an area ratio with respect to the structure of the ferrite phase as a whole of 95% or more in which fine carbides containing Ti and V and having an average particle size of less than 10 nm are precipitated dispersed, in which the volume ratio of the fine carbides with respect to the structure as a whole is 0.0050 or more, and the ratio of the number of carbides containing Ti and having a particle size of 30 nm or more in the total number of carbides is less than 10%. Further, PTL 5 describes that the hot rolled steel sheet has a difference in strength between the sheet width center part (center part) and ¼ width position of the steel sheet of within 15 MPa, has a difference in hole expansion ratio between the sheet width center part (center part) and ¼ width position of the steel sheet of within 10%, has a difference in limit bending ratio of 0.15 or less, and exhibits stability of mechanical characteristics and uniformity of strength and workability.

CITATIONS LIST

Patent Literature

[PTL 1] Japanese Unexamined Patent Publication No. 2015-004081

[PTL 2] Japanese Unexamined Patent Publication No. 10-046258

[PTL 3] Japanese Unexamined Patent Publication No. 2012-172257

[PTL 4] Japanese Unexamined Patent Publication No. 2002-121646

[PTL 5] WO 2013/069251

SUMMARY

Technical Problem

As shown in PTLs 1 to 3, etc., in the prior art, the suppression of variation in strength in hot rolled steel sheet has been studied in relatively many cases, but even if simply suppressing variation in strength, when producing a more complicated shape part accompanied with various working processes, depending on the portion of the steel sheet used for the part, sometimes cracks occur. In such a case, as a result a drop in yield is invited.

On the other hand, in PTLs 4 and 5, uniformity in the width direction in the characteristics other than strength has also been studied, but, for example, in PTL 4, the specific measurement positions in the width direction are not necessarily clear. Further, in PTL 5 as well, while a difference in characteristics between the sheet width center part and ¼ width position is shown, the uniformity including also the regions relatively near the sheet width direction where control of the characteristics is more difficult has not necessarily been sufficiently studied. If the characteristics are not sufficiently uniform in the regions relatively near the end parts in the sheet width direction, similarly cracks are formed depending on the portion of the steel sheet used for the more complicated shape part and a drop in the yield is invited.

Therefore, an object of the present invention is to provide a hot rolled steel sheet able to suppress the occurrence of cracks, etc., and improve the yield even when producing a complicated shape part.

Solution to Problem

To achieve the above object, the inventors took note of the hole expansion characteristic rather than the tensile strength, yield strength, and other characteristics such as proposed in the prior art in a high strength hot rolled steel sheet having a tensile strength of 780 MPa or more and discovered that by controlling the hole expansion characteristic to satisfy a predetermined formula, it is possible to produce even a complicated shape part with a good yield, and thereby completed the present invention.

The steel material for achieving the above object is as follows:

(1) A hot rolled steel sheet having a tensile strength of 780 MPa or more, a sheet thickness of 1.2 to 4.0 mm, and a sheet width of 750 mm or more, and satisfying the following formula 1:

$$-15 \leq (\lambda_{W1}+\lambda_{W2})/2-\lambda_C \leq 15 \quad \text{formula 1}$$

where $\lambda_{W1}$ and $\lambda_{W2}$ respectively indicate hole expansion ratios (%) at ⅛ positions of the sheet width from one end of the hot rolled steel sheet in a sheet width direction perpendicular to a rolling direction and the other end at an opposite side, $\lambda_C$ indicates a hole expansion ratio (%) of a sheet width center part, and $\lambda_{W1}$, $\lambda_{W2}$, and $\lambda_C$ are respectively 40% or more.

(2) The hot rolled steel sheet according to (1), wherein the tensile strength is 980 MPa or more.

(3) The hot rolled steel sheet according to (1) or (2), further satisfying the following formula 2:

$$-80 \leq (TS_{W1}+TS_{W2})/2-TS_C \leq 80 \quad \text{formula 2}$$

where $TS_{W1}$ and $TS_{W2}$ respectively indicate tensile strengths (MPa) at ⅛ positions of the sheet width from one end of the hot rolled steel sheet in a sheet width direction perpendicular to a rolling direction and the other end at an opposite side, and $TS_C$ indicates a tensile strength (MPa) of a sheet width center part.

(4) The hot rolled steel sheet according to any one of (1) to (3), further satisfying the following formula 3:

$$-15 \leq (\lambda_{E1}+\lambda_{E2})/2-\lambda_C \leq 15 \quad \text{formula 3}$$

where $\lambda_{E1}$ and $\lambda_{E2}$ respectively indicate hole expansion ratios (%) at positions of 75 mm to a sheet width center part side from one end of the hot rolled steel sheet in a sheet width direction perpendicular to a rolling direction and the other end at an opposite side, and $\lambda_C$ indicates a hole expansion ratio (%) of a sheet width center part.

(5) The hot rolled steel sheet according to any one of (1) to (4), wherein the sheet width is 750 to 1600 mm.

(6) The hot rolled steel sheet according to any one of (1) to (5), wherein the hot rolled steel sheet has a chemical composition comprising, by mass %, C: 0.01 to 0.50%,
Si: 0.01 to 3.50%,
Mn: 0.20 to 3.00%,
P: 0.100% or less,
S: 0.0200% or less,
N: 0.0100% or less,
Al: 0.001 to 1.000%,
Cu: 0 to 1.00%,
Ni: 0 to 0.50%,
Cr: 0 to 2.00%,
Mo: 0 to 3.00%,
W: 0 to 0.10%,
Nb: 0 to 0.060%,
V: 0 to 1.00%,
Ti: 0 to 0.20%,
B: 0 to 0.0040%,
O: 0 to 0.020%,
Ta: 0 to 0.10%,
Co: 0 to 3.00%,
Sn: 0 to 1.00%,
Sb: 0 to 0.50%,
As: 0 to 0.050%,
Mg: 0 to 0.050%,
Zr: 0 to 0.050%,
Ca: 0 to 0.0500%,
REM: 0 to 0.0500%, and
balance: Fe and impurities.

(7) The hot rolled steel sheet according to (6), wherein the chemical composition comprises, by mass %, at least one selected from the group consisting of:

Cu: 0.001 to 1.00%,
Ni: 0.001 to 0.50%,
Cr: 0.001 to 2.00%,
Mo: 0.001 to 3.00%,
W: 0.001 to 0.10%,
Nb: 0.001 to 0.060%,
V: 0.001 to 1.00%,
Ti: 0.001 to 0.20%,
B: 0.0001 to 0.0040%,
O: 0.0001 to 0.020%,
Ta: 0.001 to 0.10%,
Co: 0.001 to 3.00%,
Sn: 0.001 to 1.00%,
Sb: 0.001 to 0.50%,
As: 0.001 to 0.050%,
Mg: 0.0001 to 0.050%,
Zr: 0.0001 to 0.050%,
Ca: 0.0001 to 0.0500%, and
REM: 0.0001 to 0.0500%.

(8) The hot rolled steel sheet according to (6) or (7), wherein the content of Mo is 0.03% or less.

(9) The hot rolled steel sheet according to any one of (6) to (8), wherein the content of V is 0.11% or less.

Advantageous Effects of Invention

According to the present invention, it is possible to provide a hot rolled steel sheet able to produce even a complicated shape part with a good yield. Such a hot rolled steel sheet is particularly suitable for production of, for example, a part having a complicated shape and requiring high strength such as a part of the suspension of an automobile, and therefore the value of utilization in industry is extremely high.

DESCRIPTION OF EMBODIMENTS

<Hot Rolled Steel Sheet>

The hot rolled steel sheet according to an embodiment of the present invention is characterized in that the hot rolled steel sheet has a tensile strength of 780 MPa or more, a sheet thickness of 1.2 to 4.0 mm, and a sheet width of 750 mm or more, and satisfies the following formula 1:

$$-15 \leq (\lambda_{W1}+\lambda_{W2})/2-\lambda_C \leq 15 \quad \text{formula 1}$$

where $\lambda_{W1}$ and $\lambda_{W2}$ respectively indicate hole expansion ratios (%) at ⅛ positions of the sheet width from one end of the hot rolled steel sheet in a sheet width direction perpendicular to a rolling direction and the other end at an opposite side, $\lambda_C$ indicates a hole expansion ratio (%) of a sheet width center part, and $\lambda_{W1}$, $\lambda_{W2}$, and $\lambda_C$ are respectively 40% or more.

As explained above, if working steel sheet into a complicated shape part, etc., is required, from the viewpoint of the yield, the characteristics of the steel sheet are preferably uniform in the sheet width direction. For example, explained more specifically in relation to automobile members, in recent years application of high strength steel sheet to automobile members has been intensively studied for the purpose of improvement of the durability and improvement of the collision safety of automobiles. However, if making steel sheet high in strength, generally the workability falls and the characteristics of the steel sheet become strongly affected by the structure of the steel sheet, therefore sometimes it is not possible to make the structure of the steel sheet sufficiently uniform in the sheet width direction due to the uneven temperature in the sheet width direction at the time of production, etc. As a result, sometimes the material characteristics of steel sheet greatly differ in the sheet width direction. In particular, in the high strength steel sheet used for automobile members, etc., what positions of the steel sheet will become the burled parts and stretch flanged parts at the time of press-forming will differ with each part, therefore even if simply suppressing variation in strength, in particular variation in the tensile strength or yield strength, in the sheet width direction of steel sheet, sometimes cracks form at the time of press-forming depending on the portion of the steel sheet used for the part and as a result a drop in the yield is invited.

Therefore, the inventors took note of the hole expansion ratio of steel sheet rather than the tensile strength and other characteristics in a high strength hot rolled steel sheet having a tensile strength of 780 MPa or more and discovered that by controlling the plurality of hole expansion ratios measured in the sheet width direction to satisfy the above formula 1, it is possible to suppress the occurrence of cracks and produce even a complicated shape part with a good yield. Therefore, according to the hot rolled steel sheet according to an embodiment of the present invention, for example, even in the production of a part which has a complicated shape and requires high strength such as a suspension part of an automobile, not only is there no limitation of the portion of the steel sheet able to be used for the part and therefore it is possible to raise the freedom of design, but also this is extremely advantageous from the viewpoint of yield. In several prior art, improvement of the desired characteristics of steel sheet has been proposed by control of the tensile strength and other strength characteristics in the sheet width direction and control of the structure of the steel sheet, etc., for suppressing variation of the tensile strength and other strength, but there has never been the technical idea of control of the hole expansion characteristic in the sheet width direction, more specifically the technical idea of producing a complicated shape part with good yield from tensile strength 780 MPa or more, in particular 850 MPa or more or 980 MPa or more, high strength hot rolled steel sheet by controlling the hole expansion characteristic in the sheet width direction so as to satisfy a predetermined formula. This was first discovered by the inventors this time.

Below, the hot rolled steel sheet according to an embodiment of the present invention will be explained in more detail, but the explanation is intended to simply illustrate a preferred embodiment of the present invention and is not intended to limit the present invention to such a specific embodiment.

[Tensile Strength]

The hot rolled steel sheet according to an embodiment of the present invention may have a 780 MPa or more tensile strength, for example, 850 MPa or more, 980 MPa or more, 990 MPa or more, or 1040 MPa or more. The hot rolled steel sheet according to an embodiment of the present invention, despite having such a high tensile strength, has a hole expansion characteristic sufficiently controlled in the sheet width direction, therefore, for example, even when producing a complicated shape part by press-forming, etc., it is possible to remarkably suppress the occurrence of cracks, etc., without particular limitation as to the portion of the steel sheet used. The upper limit of the tensile strength is not particularly limited, but, for example, the tensile strength of the hot rolled steel sheet may be 2000 MPa or less, 1470 MPa or less, 1250 MPa or less, or 1180 MPa or less. The tensile strength is determined by obtaining a No. 5 tensile test piece of JIS Z2241:2011 from the sheet width ⅛ position of the hot rolled steel sheet in a direction perpendicular to the rolling direction, conducting a tensile test based on JIS Z2241: 2011 two times, and averaging the values of the tensile strength obtained. More specifically, the lower of the values of $TS_{W1}$ and $TS_{W2}$ explained in detail later is determined as the tensile strength of the hot rolled steel sheet.

[Preferable Chemical Composition of Hot Rolled Steel Sheet]

In an embodiment of the present invention, the hot rolled steel sheet may be any material satisfying the requirement of the tensile strength being 780 MPa or more. Therefore, the chemical composition of the hot rolled steel sheet is not particularly limited. It may be suitably determined in the range satisfying the requirement of the tensile strength being 780 MPa or more. More specifically, the present invention, as explained above, has as its object to provide a hot rolled steel sheet able to suppress the occurrence of cracking, etc., and improve the yield even when producing a complicated shape part. The object is achieved by a high strength hot rolled steel sheet having a tensile strength of 780 MPa or more in which the plurality of hole expansion ratios measured in the sheet width direction are controlled to satisfy the relationship of formula 1. Therefore, it is clear that the chemical composition of the hot rolled steel sheet is not a technical feature essential for achieving the object of the present invention. Below, the preferable chemical composition of the hot rolled steel sheet having the 780 MPa or more tensile strength according to an embodiment of the present invention will be explained in detail, but the explanation of these is intended to simply illustrate a hot rolled steel sheet having a 780 MPa or more tensile strength and is not intended to limit the present invention to a hot rolled steel sheet having such a specific chemical composition. Further, in the following explanation, the "%" of the units of contents of the elements, unless otherwise indicated, shall mean "mass %". Furthermore, in this Description, "to" showing a numerical range, unless otherwise indicated, is used in the sense including the numerical values described before and after it as the upper limit value and lower limit value.

[C: 0.01 to 0.50%]

C is an element effective for raising the strength of steel sheet. To sufficiently obtain such an effect, the content of C is preferably 0.01% or more. The content of C may also be 0.03% or more, 0.05% or more, 0.08% or more, 0.10% or more, or 0.12% or more. On the other hand, if excessively containing C, sometimes the toughness falls. Therefore, the content of C is preferably 0.50% or less. The content of C may also be 0.40% or less, 0.35% or less, 0.30% or less, 0.25% or less, 0.22% or less, or 0.19% or less.

[Si: 0.01 to 3.50%]

Si is an element effective for raising the strength as a solution strengthening element. To sufficiently obtain such an effect, the content of Si is preferably 0.01% or more. The content of Si may also be 0.05% or more, 0.10% or more, 0.20% or more, 0.30% or more, 0.50% or more, or 0.80% or more. On the other hand, if excessively containing Si, sometimes the toughness falls. Therefore, the content of Si is preferably 3.50% or less. The content of Si may also be 3.00% or less, 2.50% or less, 2.00% or less, 1.50% or less, 1.20% or less, or 1.00% or less.

[Mn: 0.20 to 3.00%]

Mn is an element effective for hardenability and raising the strength as a solution strengthening element. To sufficiently obtain these effects, the content of Mn is preferably 0.20% or more. The content of Mn may also be 0.50% or more, 0.80% or more, or 1.00% or more. On the other hand, if excessively containing Mn, MnS is formed in a large amount and sometimes the toughness falls. Therefore, the content of Mn is preferably 3.00% or less. The content of Mn may also be 2.70% or less, 2.50% or less, 2.00% or less, 1.60% or less, or 1.40% or less.

[P: 0.100% or Less]

P, if excessively contained, sometimes disadvantageously affects the weldability, etc. Therefore, the content of P is preferably 0.100% or less. The content of P may also be 0.080% or less, 0.050% or less, 0.030% or less, or 0.025% or less. The lower limit of P is not particularly limited and may also be 0%, but excessive reduction invites a rise in costs. Therefore, the content of P may also be 0.0001% or more, 0.001% or more, or 0.005% or more.

[S: 0.0200% or Less]

S, if contained in excess, forms MnS in large amounts and sometimes causes a drop in toughness. Therefore, the content of S is preferably 0.0200% or less. The content of S may also be 0.0150% or less, 0.0100% or less, or 0.0050% or less. The lower limit of S is not particularly limited and may also be 0%, but excessive reduction invites a rise in costs. Therefore, the content of S may also be 0.0001% or more or 0.0005% or more.

[N: 0.0100% or Less]

N, if contained in excess, forms coarse nitrides and sometimes causes a drop in toughness. Therefore, the content of N is preferably 0.0100% or less. The content of N may also be 0.0080% or less or 0.0050% or less. The lower limit of N is not particularly limited and may also be 0%, but excessive reduction invites a rise in costs. Therefore, the content of N may also be 0.0001% or more or 0.0005% or more.

[Al: 0.001 to 1.000%]

Al is an element acting as a deoxidizer. To sufficiently obtain such an effect, the content of Al is preferably 0.001% or more. The content of Al may also be 0.005% or more, 0.010% or more, or 0.015% or more. On the other hand, if excessively containing Al, sometimes coarse oxides are formed and the toughness is lowered. Therefore, the content of Al is preferably 1.000% or less. The content of Al may also be 0.500% or less, 0.300% or less, 0.200% or less, 0.100% or less, 0.050% or less, or 0.030% or less.

The basic chemical composition of the hot rolled steel sheet according to an embodiment of the present invention is as described above. Furthermore, the hot rolled steel sheet, in accordance with need, also contains at least one of the following optional elements in place of part of the Fe of the balance.

[Cu: 0 to 1.00%]

Cu is an element contributing to improvement of the strength and/or corrosion resistance. The content of Cu may be 0%, but to obtain these effects, the content of Cu is preferably 0.001% or more. The content of Cu may also be 0.01% or more, 0.05% or more, or 0.10% or more. On the other hand, if excessively containing Cu, deterioration of the toughness or weldability is sometimes invited. Therefore, the content of Cu is preferably 1.00% or less. The content of Cu may also be 0.80% or less, 0.60% or less, 0.40% or less, 0.25% or less, or 0.15% or less.

[Ni: 0 to 0.50%]

Ni is an element raising the hardenability of steel and contributing to improvement of the strength and/or heat resistance. The content of Ni may be 0%, but to obtain these effects, the content of Ni is preferably 0.001% or more. The content of Ni may also be 0.01% or more, 0.03% or more, or 0.05% or more. On the other hand, even if excessively containing Ni, the effect becomes saturated and a rise in production costs is liable to be invited. Therefore, the content of Ni is preferably 0.50% or less. The content of may also be 0.40% or less, 0.30% or less, 0.20% or less, or 0.10% or less.

[Cr: 0 to 2.00%]

Cr is an element raising the hardenability of steel and/or contributing to improvement of the strength. The content of Cr may be 0%, but to obtain these effects, the content of Cr is preferably 0.001% or more. The content of Cr may also be 0.01% or more, 0.03% or more, or 0.10% or more. On the other hand, even if excessively containing Cr, the alloy costs increase and, in addition, sometimes the toughness falls. Therefore, the content of Cr is preferably 2.00% or less. The content of Cr may also be 1.50% or less, 1.00% or less, 0.50% or less, 0.30% or less, or 0.15% or less.

[Mo: 0 to 3.00%]

Mo is an element raising the hardenability of steel and contributing to improvement of the strength and is an element contributing to improvement of the corrosion resistance as well. The content of Mo may be 0%, but to obtain these effects, the content of Mo is preferably 0.001% or more. The content of Mo may also be 0.005% or more, 0.01% or more, or 0.02% or more. On the other hand, if excessively containing Mo, the deformation resistance at the time of hot working increases and sometimes the load on the facilities becomes greater. Therefore, the content of Mo is preferably 3.00% or less. The content of Mo may also be 2.00% or less, 1.00% or less, or 0.50% or less. For example, if Mo is not included or if the content of Mo is low, in high strength steel sheet, the variation in quality sometimes becomes relatively high. However, in the hot rolled steel sheet according to an embodiment of the present invention, regardless of the content of Mo, it is possible to make the hole expansion characteristic and other material characteristics in the sheet width direction uniform. Therefore, the content of Mo may also, as explained above, be 0%, for example, less than 0.05%, 0.04% or less, or 0.03% or less.

[W: 0 to 0.10%]

W is an element raising the hardenability of steel and contributing to improvement of the strength. The content of W may be 0%, but to obtain such an effect, the content of W is preferably 0.001% or more. The content of W may also be 0.005% or more or 0.01% or more. On the other hand, if excessively containing W, the weldability sometimes falls. Therefore, the content of W is preferably 0.10% or less. The content of W may also be 0.08% or less, 0.05% or less, or 0.03% or less.

[Nb: 0 to 0.060%]

Nb is an element contributing to improvement of strength by precipitation strengthening, etc. The content of Nb may be 0%, but to obtain such an effect, the content of Nb is preferably 0.001% or more. The content of Nb may also be 0.005% or more, 0.010% or more, or 0.020% or more. On the other hand, even if excessively including Nb, the effect becomes saturated and sometimes the toughness falls. Therefore, the content of Nb is preferably 0.060% or less. The content of Nb may also be 0.050% or less or 0.030% or less.

[V: 0 to 1.00%]

V is an element contributing to improvement of strength by precipitation strengthening, etc. The content of V may be 0%, but to obtain such an effect, the content of V is preferably 0.001% or more. The content of V may also be 0.01% or more, 0.03% or more, or 0.05% or more. On the other hand, if excessively containing V, a large amount of precipitates is formed and sometimes causes a drop in toughness. Therefore, the content of V is preferably 1.00% or less. The content of V may also be 0.80% or less, 0.50% or less, 0.30% or less, 0.11% or less, or 0.07% or less.

[Ti: 0 to 0.20%]

Ti is an element contributing to improvement of the strength by precipitation strengthening, etc. The content of Ti may be 0%, but to obtain such an effect, the content of Ti is preferably 0.001% or more. The content of Ti may also be 0.01% or more, 0.03% or more, or 0.05% or more. On the other hand, if excessively containing Ti, sometimes a large amount of precipitates are formed and the toughness is lowered. Therefore, the content of Ti is preferably 0.20% or less. The content of Ti may also be 0.15% or less, 0.12% or less, or 0.07% or less.

[B: 0 to 0.0040%]

B is an element raising the hardenability of steel and contributing to improvement of the strength. The content of B may be 0%, but to obtain such an effect, the content of B is preferably 0.0001% or more. The content of B may also be 0.0002% or more, 0.0003% or more, or 0.0005% or more. On the other hand, if excessively containing B, sometimes the toughness and/or weldability falls. Therefore, the content of B is preferably 0.0040% or less. The content of B may also be 0.0030% or less, 0.0020% or less, or 0.0010% or less.

[O: 0 to 0.020%]

O is an element entering in the process of production. The content of O may also be 0%. However, reducing the content of O to less than 0.0001% requires time for the refining and invites a drop in productivity. Therefore, the content of O may also be 0.0001% or more, 0.0005% or more, or 0.001% or more. On the other hand, if excessively containing O, coarse inclusions are formed and sometimes the toughness of the steel material is lowered. Therefore, the content of O is preferably 0.020% or less. The content of O may also be 0.015% or less, 0.010% or less, or 0.005% or less.

[Ta: 0 to 0.10%]

Ta is an element effective for control of the form of carbides and increase of strength. The content of Ta may be 0%, but to obtain these effects, the content of Ta is preferably 0.001% or more. The content of Ta may also be 0.005% or more, 0.01% or more, or 0.02% or more. On the other hand, if excessively containing Ta, fine Ta carbides precipitate in a large amount, an excessive rise in strength of the steel material is invited and as a result sometimes the toughness falls. Therefore, the content of Ta is preferably 0.10% or less. The content of Ta may also be 0.08% or less, 0.06% or less, or 0.04% or less.

[Co: 0 to 3.00%]

Co is an element contributing to improvement of the hardenability and/or heat resistance. The content of Co may be 0%, but to obtain these effects, the content of Co is preferably 0.001% or more. The content of Co may also be 0.01% or more, 0.02% or more, or 0.05% or more. On the other hand, if excessively containing Co, sometimes the hot workability falls. This also leads to an increase in the raw material costs. Therefore, the content of Co is preferably 3.00% or less. The content of Co may also be 2.00% or less, 1.00% or less, 0.50% or less, 0.20% or less, or 0.10% or less.

[Sn: 0 to 1.00%]

Sn is an element effective for improvement of the corrosion resistance. The content of Sn may be 0%, but to obtain such an effect, the content of Sn is preferably 0.001% or more. The content of Sn may also be 0.005% or more, 0.01% or more, or 0.02% or more. On the other hand, if excessively containing Sn, sometimes a drop in toughness is invited. Therefore, the content of Sn is preferably 1.00% or less. The content of Sn may also be 0.80% or less, 0.50% or less, 0.30% or less, 0.10% or less, or 0.05% or less.

[Sb: 0 to 0.50%]

Sb is an element effective for improvement of the corrosion resistance. The content of Sb may be 0%, but to obtain such an effect, the content of Sb is preferably 0.001% or more. The content of Sb may also be 0.005% or more or 0.01% or more. On the other hand, if excessively containing Sb, sometimes a drop in toughness is invited. Therefore, the content of Sb is preferably 0.50% or less. The content of Sb may also be 0.30% or less, 0.10% or less, or 0.05% or less.

[As: 0 to 0.050%]

As is an element effective for improving the machinability of steel. The content of As may be 0%, but to obtain such an effect, the content of As is preferably 0.001% or more. The content of As may also be 0.005% or more or 0.010% or more. On the other hand, if excessively containing As, the hot workability sometimes falls. Therefore, the content of As is preferably 0.050% or less. The content of As may also be 0.040% or less, 0.030% or less, or 0.020% or less.

[Mg: 0 to 0.050%]

Mg is an element able to control the form of sulfides. The content of Mg may be 0%, but to obtain such an effect, the content of Mg is preferably 0.00010% or more. The content of Mg may also be 0.0005% or more, 0.001% or more, or 0.005% or more. On the other hand, if excessively containing Mg, sometimes the toughness falls due to the formation of coarse inclusions. Therefore, the content of Mg is preferably 0.050% or less. The content of Mg may also be 0.030% or less, 0.020% or less, or 0.015% or less.

[Zr: 0 to 0.050%]

Zr is an element able to control the form of sulfides. The content of Zr may be 0%, but to obtain such an effect, the content of Zr is preferably 0.0001% or more. The content of Zr may also be 0.003% or more, 0.005% or more, or 0.01% or more. On the other hand, even if excessively including Zr, the effect becomes saturated and therefore inclusion of Zr more than necessary in the steel material is liable to invite a rise in the production costs. Therefore, the content of Zr is preferably 0.050% or less. The content of Zr may also be 0.040% or less, 0.030% or less, or 0.020% or less.

[Ca: 0 to 0.0500%]

Ca is an element able to control the form of sulfides by addition of a trace amount. The content of Ca may be 0%, but to obtain such an effect, the content of Ca is preferably 0.00010% or more. The content of Ca may also be 0.0005% or more, 0.0010% or more, or 0.0020% or more. On the other hand, even if excessively including Ca, the effect becomes saturated and therefore inclusion of Ca more than necessary in the steel material is liable to invite a rise in the production costs. Therefore, the content of Ca is preferably 0.0500% or less. The content of Ca may also be 0.0300% or less, 0.0200% or less, 0.0100% or less, 0.0070% or less, or 0.0040% or less.

[REM: 0 to 0.0500%]

REM, in the same way as Ca, includes elements able to control the form of sulfides by addition of a trace amount. The content of REM may be 0%, but to obtain such an effect, the content of REM is preferably 0.0001% or more. The content of REM may also be 0.0005% or more, 0.0010% or more, or 0.0020% or more. On the other hand, if excessively including REM, coarse inclusions are formed and sometimes the toughness of the steel sheet is lowered. Therefore, the content of REM is preferably 0.0500% or less. The content of REM may also be 0.0300% or less, 0.0200% or less, 0.0100% or less, 0.0070% or less, or 0.0040% or less. In this Description, "REM" is the overall name for the 17 elements of scandium (Sc) of atomic number 21, yttrium (Y) of atomic number 39, and, in the lanthanides, lanthanum (La) of atomic number 57 to lutetium (Lu) of atomic number 71. The content of REM is the total content of these elements.

In the hot rolled steel sheet according to an embodiment of the present invention, the balance other than the above elements consists of Fe and impurities. "Impurities" are constituents, etc., entering due to various factors in the production process, first and foremost raw materials such as ore and scrap, etc., when industrially producing the hot rolled steel sheet.

[Sheet Thickness]

The hot rolled steel sheet according to an embodiment of the present invention has a sheet thickness of 1.2 to 4.0 mm. By prescribing the sheet thickness within a suitable range, it is possible to make the hole expansion ratio in the sheet width direction reliably satisfy formula 1. The sheet thickness may be 1.5 mm or more or 2.0 mm or more and/or may be 3.5 mm or less or 3.0 mm or less. In the present invention, the "sheet thickness" means the sheet thickness at the sheet width center part.

[Sheet Width]

The hot rolled steel sheet according to an embodiment of the present invention has a sheet width of 750 mm or more. By prescribing the sheet width within a suitable range, it is possible to make the hole expansion ratio in the sheet width direction reliably satisfy formula 1. For example, the sheet width may be 800 mm or more, 900 mm or more, or 1000 mm or more. The upper limit of the sheet width is not particularly limited, but from the viewpoint of making the hole expansion ratio in the sheet width direction more reliably satisfy formula 1, the sheet width is preferably 2500 mm or less and may be 2000 mm or less, 1800 mm or less, 1600 mm or less, 1500 mm or less, 1400 mm or less, or 1300 mm or less.

[$-15 \leq (\lambda_{W1}+\lambda_{W2})/2-\lambda_C \leq 15$]

The hot rolled steel sheet according to an embodiment of the present invention satisfies the following formula 1:

$$-15 \leq (\lambda_{W1}+\lambda_{W2})/2-\lambda_C \leq 15 \quad \text{formula 1}$$

where $\lambda_{W1}$ and $\lambda_{W2}$ respectively indicate hole expansion ratios (%) at ⅛ positions of the sheet width from one end of the hot rolled steel sheet in the sheet width direction perpendicular to the rolling direction and the other end at the opposite side, while $\lambda_C$ indicates the hole expansion ratio (%) of the sheet width center part. In the present invention, one end of the hot rolled steel sheet in the sheet width direction and the other end at the opposite side need only be in a relation of opposite sides to each other and are not limited to specific sides of the hot rolled steel sheet. Therefore, the one end may be the so-called work side (one side of steel sheet in sheet width direction which operator works on) or drive side (other side of steel sheet in sheet width direction at which drive device is set). Similarly, the other side may be the work side or the drive side. By the hole expansion ratios of the two end parts and center part in the sheet width direction satisfying the relationship of formula 1, the hole expansion property in the sheet width direction becomes uniform, therefore, in relation to this, the burring ability and stretch flangeability, etc., of the hot rolled steel sheet in the sheet width direction can be made uniform. Therefore, by press-forming, etc., a complicated shape part can be produced with a good yield. $(\lambda_{W1}+\lambda_{W2})/2-\lambda_C$ is preferably −14 or more, more preferably −12 or more, still more preferably −10 or more, most preferably −8 or more. Similarly, $(\lambda_{W1}+\lambda_{W2})/2-\lambda_C$ is preferably 14 or less, more preferably 12 or less, still more preferably 10 or less, most preferably 8 or less.

In the hot rolled steel sheet according to an embodiment of the present invention, the hole expansion ratios $\lambda_{W1}$, $\lambda_{W2}$, and $\lambda_C$ are respectively 40% or more. By satisfying the above formula 1 while making $\lambda_{W1}$, $\lambda_{W2}$, and $\lambda_C$ respectively 40% or more, even when shaping a hot rolled steel sheet cold to produce a structural member, etc., it is possible to reliably produce a complicated shape part without being particularly limited to the portion of the steel sheet used. The hole expansion ratios $\lambda_{W1}$, $\lambda_{W2}$, and $\lambda_C$ may respectively be 41% or more, 42% or more, 43% or more, 44% or more, 45% or more, 47% or more, 49% or more, or 52% or more. The upper limit values are not particularly limited, but the hole expansion ratios $\lambda_{W1}$, $\lambda_{W2}$, and $\lambda_C$ may, for example, be respectively 90% or less, 85% or less, or 80% or less.

The hole expansion ratios $\lambda_{W1}$, $\lambda_{W2}$, and $\lambda_C$ are determined in the following way by performing hole expansion tests based on JIS Z2256: 2020. First, test pieces are taken at a ⅛ position of sheet width from the sheet width direction end part of either the work side or drive side of the hot rolled steel sheet toward the sheet width center part in a direction vertical to the rolling direction and on the same line, the sheet width center part, and, furthermore, the ⅞ position of the sheet width in directions perpendicular to the rolling direction. Next, at positions of the obtained test pieces corresponding to the sheet width ⅛ position, the sheet width center part, and the sheet width ⅞ position, diameter 10 mm circular holes (initial holes: hole diameter d0=10 mm) are punched under conditions giving a clearance of 12.5% and the burrs made to form at the die side. A vertex 60° conical punch is used to expand the initial holes until cracks passing through the sheet thickness formed. The hole diameters d1mm when the cracks formed are measured and the following formula is used to find the hole expansion ratios λ (%) of the test pieces. The hole expansion test is conducted five times on different test pieces and the average values of the hole expansion ratios (%) at ⅛ positions of sheet width from one end in the sheet width direction and the other end at the opposite side and the sheet width center part are determined as respectively $\lambda_{W1}$, $\lambda_{W2}$, and $\lambda_C$:

$$\lambda=100\times(d1-d0)/d0$$

$$[-80\leq(TS_{W1}+TS_{W2})/2-TS_C\leq 80]$$

According to a preferable embodiment of the present invention, the hot rolled steel sheet satisfies the following formula 2 in addition to the above formula 1:

$$-80\leq(TS_{W1}+TS_{W2})/2-TS_C\leq 80 \quad \text{formula 2}$$

where $TS_{W1}$ and $TS_{W2}$ respectively indicate tensile strengths (MPa) at ⅛ positions of the sheet width from one end of the hot rolled steel sheet in the sheet width direction perpendicular to the rolling direction and the other end at the opposite side while $TS_C$ indicates the tensile strength (MPa) of the sheet width center part. By the tensile strengths at the two end parts and center part in the sheet width direction satisfying the relationship of formula 2, the tensile strength in the sheet width direction is made uniform, therefore it becomes possible to remarkably improve the toughness of the hot rolled steel sheet in the sheet width direction. $(TS_{W1}+TS_{W2})/2-TS_C$ is preferably −60 or more, more preferably −40 or more, still more preferably −30 or more, most preferably −25 or more. Similarly, $(TS_{W1}+TS_{W2})/2-TS_C$ is preferably 60 or less, more preferably 40 or less, still more preferably 30 or less, most preferably 25 or less.

The tensile strengths $TS_{W1}$, $TS_{W2}$, and $TS_C$ are determined in the following way. First, No. 5 tensile test pieces of JIS Z2241: 2011 are taken at a ⅛ position of sheet width from the sheet width direction end part of either the work side or drive side of the hot rolled steel sheet toward the sheet width center part in a direction vertical to the rolling direction and on the same line, the sheet width center part, and, furthermore, the ⅞ position of the sheet width in directions perpendicular to the rolling direction. Next, using the obtained test pieces, tensile tests based on JIS Z2241: 2011 are performed and the tensile strengths (MPa) of the test pieces are found. The tensile tests are performed two times on different test pieces and the average values of the tensile strengths (MPa) of the ⅛ positions of sheet width from one end in the sheet width direction and the other end at the opposite side and the sheet width center part are respectively determined as $TS_{W1}$, $TS_{W2}$, and $TS_C$. In the present invention, when simply referring to the tensile strength or the tensile strength of the hot rolled steel sheet, it means the lower value among $TS_{W1}$ and $TS_{W2}$.

$$[-15\leq(\lambda_{E1}+\lambda_{E2})/2-\lambda_C\leq 15]$$

According to a preferable embodiment of the present invention, the hot rolled steel sheet further satisfies the following formula 3 in addition to the above formula 1 and/or formula 2:

$$-15\leq(\lambda_{E1}+\lambda_{E2})/2-\lambda_C\leq 15 \quad \text{formula 3}$$

where $\lambda_{E1}$ and $\lambda_{E2}$ respectively indicate the hole expansion ratios (%) at positions of 75 mm to the sheet width center part side from one end of the hot rolled steel sheet in the sheet width direction perpendicular to the rolling direction and the other end at the opposite side, while $\lambda_C$ indicates the hole expansion ratio (%) of the sheet width center part as explained regarding the above formula 1. By the hole expansion ratios of the two end parts and center part in the sheet width direction satisfying the relationship of formula 3, the hole expansion characteristic is reliably made uniform even in regions closer to the end parts in the sheet width direction. For this reason, compared with the case of simply satisfying formula 1, it is possible to make the burring ability and stretch flangeability in the sheet width direction of the hot rolled steel sheet more uniform and possible to produce a complicated shape part by press-forming with further better yield. $(\lambda_{E1}+\lambda_{E2})/2-\lambda_C$ is preferably −14 or more, more preferably −12 or more, still more preferably −10 or more, most preferably −8 or more. Similarly, $(\lambda_{E1}+\lambda_{E2})/2-\lambda_C$ is preferably 14 or less, more preferably 12 or less, still more preferably 10 or less, most preferably 8 or less.

The specific values of the hole expansion ratios $\lambda_{E1}$ and $\lambda_{E2}$ need only satisfy the above formula 3. While not particularly limited, they are preferably 30% or more. The hole expansion ratios $\lambda_{E1}$ and $\lambda_{E2}$ may respectively be 33% or more, 35% or more, 40% or more, 45% or more, 47% or more, 49% or more, or 52% or more. The upper limit values are not particularly prescribed, but the hole expansion ratios $\lambda_{E1}$ and $\lambda_{E2}$, for example, may be 90% or less, 85% or less, or 80% or less. The hole expansion ratios $\lambda_{E1}$ and $\lambda_{E2}$ are determined by performing hole expansion tests based on JIS Z2256: 2020 in the same way as explained above for the hole expansion ratios $\lambda_{W1}$ and $\lambda_{W2}$ except for obtaining the test pieces from positions of 75 mm from one end of the sheet width direction and the other end at the opposite side to the sheet width center part side instead of the ⅛ position and ⅞ position of the sheet width.

[Microstructure]

The microstructure of the hot rolled steel sheet may be any microstructure satisfying the requirement of the tensile strength being 780 MPa or more. While not particularly limited, for example, the microstructure of the hot rolled steel sheet may contain ferrite and bainite in a total of more than 50 area %, 55 area % or more, 60 area % or more, or 70 area % or more. Further, the microstructure of the hot rolled steel sheet may be comprised of only ferrite and bainite, i.e., may contain ferrite and bainite in a total of 100 area %. For example, the microstructure of the hot rolled steel sheet may contain ferrite and bainite in a total of 95 area % or less, 90 area % or less, 85 area % or less, or 80 area % or less. The microstructure of the hot rolled steel sheet may contain ferrite in 90 area % or less, 80 area % or less, 75 area % or less, or 70 area % or less. The bainite in the microstructure of the hot rolled steel sheet may be 15 area % or more, 25 area % or more, 35 area % or more, 45 area % or more, or 50 area % or more and may be 90 area % or less, 95 area % or less, 85 area % or less, 75 area % or less, 65 area % or less, or 60 area % or less. The microstructure of the hot rolled steel sheet need not include martensite, but if including martensite, the content of martensite is preferably 20 area % or less, 15 area % or less, 10 area % or less, or 5 area % or less. The microstructure of the hot rolled steel sheet can include structures other than ferrite, bainite, and martensite, for example, retained austenite and pearlite, etc. These remaining structures are preferably 20 area % or less, 15 area % or less, 10 area % or less, or 5 area % or less.

The microstructure is identified and the area ratio calculated by the following methods. First, a sample obtained from the ¼ depth position of sheet thickness of the hot rolled steel sheet is polished, then etched by Nital. Next, an optical microscope is used for image analysis of the structural photograph obtained in a 300 μm×300 μm field to thereby obtain the area ratios of ferrite and pearlite and the total area ratio of bainite and martensite. Next, a LePera corroded sample is used and an optical microscope employed for image analysis of a structural photograph obtained at ¼ depth position of sheet thickness in a 300 μm×300 μm field to calculate the total area ratio of the retained austenite and martensite. Furthermore, a sample obtained from ¼ depth of sheet thickness from the normal direction of the rolled surface is used to find the volume ratio of retained austenite by X-ray diffraction measurement. The volume ratio of the retained austenite is equal to the area ratio, therefore this is made the area ratio of the retained austenite. The area ratio of the retained austenite obtained by X-ray diffraction measurement can be subtracted from the total area ratio of the retained austenite and martensite obtained by an optical microscope and image analysis to calculate the area ratio of martensite. Furthermore, this area ratio of martensite can be subtracted from the total area ratio of bainite and martensite obtained by an optical microscope and image to calculate the area ratio of bainite. Therefore, the above method can be used to obtain the area ratios of ferrite, bainite, martensite, retained austenite, and pearlite.

<Method of Production of Hot Rolled Steel Sheet>

Next, a preferred method of production of the hot rolled steel sheet according to an embodiment of the present invention will be explained. The following explanation is intended to illustrate the characteristic method for producing the hot rolled steel sheet according to an embodiment of the present invention and is not intended to limit the hot rolled steel sheet to one produced by a method of production such as explained below.

A preferred method of production of the hot rolled steel sheet according to an embodiment of the present invention includes a hot rolling step for hot rolling a slab having a predetermined chemical composition and a cooling step for cooling and coiling the obtained rolled material and is characterized by the rolling load (ton) of the final rolling stand at the hot rolling step and the difference (° C./s) of the average cooling speeds due to water cooling between the ⅛ positions of sheet width from the two end parts in the sheet width direction and the sheet width center part in the cooling step satisfying the following formula 4.

$$1.0 \leq t \times R^{0.5}/\Delta CR \leq 10.0 \quad \text{formula 4}$$

where, "t" indicates the sheet thickness (mm) at the sheet width center part of the hot rolled steel sheet, R indicates the rolling load (ton) of the final rolling stand at the hot rolling step and is 800 to 3000 ton, ΔCR indicates the difference (CR1−CR2) between the average cooling speed CR1 (° C./s) by water cooling of the sheet width center part in the cooling step and the average cooling speed CR2 (° C./s) by water cooling of the ⅛ position of sheet width from the two end parts in the sheet width direction, and CR1 is 20° C./s or more. Below, the steps will be explained in detail.

[Hot Rolling Step]

In this step, for example, the slab having the chemical composition explained above in relation to the hot rolled steel sheet is supplied to the hot rolling. The slab used is preferably cast by continuous casting from the viewpoint of productivity, but may also be produced by the ingot making method or thin slab casting method. Further, the cast slab may optionally be roughly rolled before the finish rolling so as to adjust the sheet thickness, etc. Such rough rolling is not particularly limited in conditions; it is sufficient that the desired sheet bar dimensions can be secured. The hot rolling can be performed under any suitable conditions except for the requirement regarding the control of the rolling load, explained in detail later. While not particularly limited, it is for example performed under conditions giving a completion temperature of finish rolling of 750° C. or more. This is because if the completion temperature of the finish rolling is too low, the rolling reaction force rises and the desired sheet thickness becomes difficult to stably obtain. The upper limit is not particularly prescribed, but, for example, the completion temperature of the finish rolling is 1050° C. or less. Further, the rolling reduction of the final stage may be suitably determined considering the desired sheet thickness, etc., and is not particularly limited, but, for example, may be 10% or more or 20% or more.

[Cooling Step]

In this step, the rolled material after hot rolling is water cooled on a run out table (ROT) under the cooling conditions explained in detail later, then, for example, is coiled at 600° C. or less or 500° C. or less in temperature. The average cooling speed by water cooling, to obtain the desired tensile strength, is 20° C./s or more and may be 30° C./s or more or 40° C./s or more at the sheet width center part (i.e., CR1). The upper limit of the average cooling speed by water cooling is not particularly prescribed, but, for example, the average cooling speed by water cooling may be 200° C./s or less, 150° C./s or less, 100° C./s or less, or 80° C./s or less at the sheet width center part.

[$1.0 \leq t \times R^{0.5}/\Delta CR \leq 10.0$]

For example, by controlling the cooling end temperature of the rolled material in the cooling step to match with the sheet width direction, it is possible to make the microstructure of the hot rolled steel sheet uniform to a certain extent and suppress variation in the tensile strength and other strength characteristics in the sheet width direction. However, the hole expansion characteristic of the hot rolled steel sheet is affected by not only the cooling conditions, but also the aggregate structure, therefore with just controlling the cooling conditions in the sheet width direction, it is not possible to reliably satisfy the requirement of formula 1 shown above. To make the hole expansion characteristic uniform in the sheet width direction, it is important to utilize the recrystallization due to rolling so as to make the aggregate structure random and form an isotropic structure. In the case of cold rolled steel sheet, it is possible to make the material characteristics of the steel sheet uniform in the sheet width direction relatively easily in the cold rolling step or the subsequent annealing step, but in the case of hot rolled steel sheet, there are no such steps, therefore making the hole expansion characteristic and other material characteristics uniform in the sheet width direction is generally extremely difficult. As opposed to this, in a preferable method of production of the hot rolled steel sheet according to an embodiment of the present invention, by considering the distribution of distortion in the sheet width direction while suitably controlling the cooling speed, it is possible to effectively control the state of recrystallization in the sheet width direction and thereby achieve a uniform hole expansion characteristic in the sheet width direction satisfying formula 1.

In the past, effort had mainly been poured into control of the crown of steel sheet due to mainly deflection of the rolling rolls in the sheet width direction of steel sheet (the phenomenon of the sheet width center part becoming thicker compared with the end parts in the sheet width direction) and control of the waviness due to transformation and contraction during cooling, etc. The distribution of distortion in the sheet width direction and the steel sheet characteristics have not been sufficiently controlled. This time, the inventors analyzed the heat history and distortion due to hot rolling by utilizing models and recorded temperatures, etc. As a result, they discovered that by suitably controlling the cooling speed at the later cooling step in accordance with the distribution of distortion at the time of hot rolling as shown in the following formula 4, it is possible to make the hole expansion characteristic in the sheet width direction of the hot rolled steel sheet uniform.

$$1.0 \leq t \times R^{0.5}/\Delta CR \leq 10.0 \quad \text{formula 4}$$

where, "t" indicates the sheet thickness (mm) at the sheet width center part of the hot rolled steel sheet, R indicates the rolling load (ton) of the final rolling stand at the hot rolling step and is 800 to 3000 ton, ΔCR indicates the difference (CR1−CR2) between the average cooling speed CR1 (° C./s) by water cooling of the sheet width center part in the cooling step and the average cooling speed CR2 (° C./s) by water cooling of the ⅛ position of sheet width from the two end parts in the sheet width direction, and CR1 is 20° C./s or more. For example, if the cooling by water cooling is two-stage cooling including air cooling or other cooling not water cooling in between, it is necessary to satisfy formula 4 by both the first stage and second stage of water cooling. Further, if the average cooling speed CR2 differs at the two sides in the sheet width direction, the smaller of the average cooling speeds is prescribed as CR2.

The hole expansion characteristic is improved, as explained above, by making the aggregate structure random and forming an isotropic structure. Therefore, aside from the control by formula 4 as well, for example, it is also possible to make the crown smaller and make the distribution of distortion in the sheet width direction as uniform as possible and, in addition, in accordance with need, suitably adjust the other parameters relating to hot rolling and cooling after that so as to effectively control the state of recrystallization in the sheet width direction and thereby achieve a uniform hole expansion characteristic in the sheet width direction satisfying formula 1.

Explaining the above formula 4 in more detail, first, a distribution of distortion in the sheet width direction occurs due to the crown of the steel sheet and deflection of the rolling rolls. Here, it is generally known that in the crown and deflection of the rolling rolls, the sheet thickness of the steel sheet and load are the dominant factors. A change in sheet thickness at the crown appears as a distribution of distortion at the final rolling stand in the hot rolling step and affects the later transformation behavior. For this reason, it is possible to learn the distribution of distortion in the sheet width direction from the sheet thickness "t" (mm) of the sheet width center part of the hot rolled steel sheet and the rolling load R (ton) of the final rolling stand. In the present method of production, the distribution of distortion is defined as $t \times R^{0.5}$. If, despite having such a distribution of distortion in the sheet width direction, the cooling end temperature and the cooling speed are controlled in a single manner in the sheet width direction, it is not possible to make the structure of the steel sheet uniform from the viewpoint of the hole expansion characteristic, etc., therefore control of the cooling speed in accordance with the distribution of distortion becomes important. In particular, if performing high load hot rolling, the crown becomes larger and the distribution of distortion becomes greater, i.e., the rolling reduction of the sheet width direction end parts becomes extremely large compared with the sheet width center part, therefore control of the cooling speed in accordance with this becomes extremely important. In the present method of production, such control of the cooling speed is defined by the difference ΔCR (° C./s) of the average cooling speeds due to water cooling at the ⅛ positions of sheet width from the two end parts in the sheet width direction and the sheet width center part.

For example, if the rolling load is high, the crown becomes larger, the distortion in the sheet width direction becomes uneven, the rolling reduction becomes higher the closer the position to the end parts in the sheet width direction, and therefore the distortion introduced becomes greater. On the other hand, the steel sheet right after being finish rolled in the hot rolling step is not uniform in temperature distribution in the sheet width direction, but has a temperature distribution in which the center part is higher in temperature and the end parts are lower. This is due to, compared with the center part, the end parts being smaller in sheet thickness, further, due to such a gradient in sheet thickness, the cooling water flowing from the center part to the end parts, etc. Therefore, if performing high load hot rolling, the drop in temperature becomes larger toward the sheet width direction end parts. The higher the distortion, the faster the transformation proceeds, therefore if performing high load hot rolling, to make the speed of transformation of the sheet width direction uniform, it is necessary to increase the average cooling speed CR1 at the sheet width center part with relatively little distortion and decrease the average cooling speed CR2 at the sheet width end parts with relatively large distortion, i.e., it is necessary to increase the difference ΔCR of average cooling speeds expressed by CR1−CR2.

The method for realizing the desired ΔCR by changing the average cooling speed between the sheet width center part and the sheet width direction end parts is not particularly limited. Any suitable method known to persons skilled in the art can be utilized. For example, it is possible to realize the desired ΔCR by stopping spraying the cooling water at specific locations in the sheet width direction or suitably adjusting the amount of spray. In addition, to reliably make the tensile strength in the sheet width direction uniform, it is preferable to make the cooling stop temperature uniform in the sheet width direction. While not particularly limited, the cooling stop temperature may, for example, be 600° C. or less or 500° C. or less.

For example, in the above formula 4, if the value of $t \times R^{0.5}/\Delta CR$ is less than 1.0, the difference in cooling speed is large with respect to the rolling load, therefore the sheet width direction center part is rapidly cooled and variation occurs in the transformation speed and sometimes uniform material characteristics are no longer obtained in the sheet width direction. On the other hand, if this value is more than 10.0, the difference in cooling speed with respect to the rolling load is small, therefore the driving force of transformation at the sheet width direction end parts is high. Similarly, variation occurs in the speed of transformation in the sheet width direction and sometimes uniform material characteristics are no longer obtained in the sheet width direction. Further, if the rolling load is too low, the state of recrystallization cannot be effectively controlled. As a result, sometimes material characteristics uniform in the sheet width direction can no longer be obtained. Therefore, the rolling load is 800 ton or more and may be 850 ton or more or 900 ton or more. On the other hand, if the rolling load is too high, it is not possible to suitably control the crown. As a result, similarly, sometimes uniform material characteristics are no longer obtained in the sheet width direction. Therefore, the rolling load is 3000 ton or less and may be 2500 ton or less or 2000 ton or less. According to the above method of production, it is possible to reliably and stably produce a hot rolled steel sheet having uniform material characteristics in the sheet width direction. Furthermore, according to a preferred method of production, the value of $t \times R^{0.5}/\Delta CR$ is controlled so as to satisfy the following formula 5.

$$2.5 \leq t \times R^{0.5}/\Delta CR \leq 7.5 \quad \text{formula 5}$$

By satisfying formula 5, it becomes possible to make the material characteristics uniform even at regions closer to the end parts in the sheet width direction, specifically up to positions 75 mm from one end in the sheet width direction and the other end at the opposite side toward the sheet width center part side. In other words, by satisfying the above formula 5, it becomes possible to produce the hot rolled steel sheet satisfying formula 3 shown before. Generally, control of the material characteristics becomes more difficult the closer the region to the end parts in the sheet width direction. However, according to the present method of production, by suitably controlling the sheet thickness "t" (mm) at the sheet width center part of the hot rolled steel sheet, the rolling load R (ton) of the final rolling stand at the hot rolling step, and the difference ΔCR (° C./s) of the average cooling speeds at the cooling step so as to satisfy formula 5, it is possible to achieve such control of the material characteristics relatively easily.

The hot rolled steel sheet of the present invention, as explained above, has uniform material characteristics in the sheet width direction, therefore by using the hot rolled steel sheet of the present invention, it is possible to produce even a complicated shape part with a good yield. Further, the hot rolled steel sheet of the present invention has a high tensile strength of 780 MPa or more, therefore, for example, is particularly useful for use for a part like a lower arm or other automobile suspension part which has a complicated shape and is required to be high in strength.

Below, examples will be used to explain the present invention in more detail, but the present invention is not limited to these examples in any way.

EXAMPLES

First, continuous casting was used to produce slabs having the chemical compositions shown in Tables 1-1 and 1-2. Next, in each of these slabs, using the hot rolling and cooling conditions shown in Tables 2-1 and 2-2, in particular the rolling load R (ton) of the final rolling stand in hot rolling, the difference ΔCR (CR1−CR2) between the average cooling speed CR1 (° C./s) by water cooling of the sheet width center part in the subsequent cooling and the average cooling speed CR2 (° C./s) by water cooling of the ⅛ positions of sheet width from the two end parts in the sheet width direction was changed as shown in Tables 2-1 and 2-2 so as to produce hot rolled steel sheets having various sheet thicknesses and the sheet widths. The average cooling speeds of the sheet width center part and the sheet width direction end parts were changed by stopping the spraying of cooling water to specific locations in the sheet width direction or suitably adjusting the amounts sprayed. Further, the chemical composition obtained by analysis of a sample taken from each of the hot rolled steel sheets produced was substantially unchanged from the chemical composition of the slab shown in Tables 1-1 and 1-2. Furthermore, the microstructure of the each of the hot rolled steel sheets was determined by image analysis of the area ratios (%) of the ferrite (a), bainite (B), martensite (M), and other structures using an optical microscope as explained previously.

TABLE 1

Table 1-1

| Steel | Chemical composition (mass %), balance: Fe and impurities | | | | | | | | | | | | | |
|---|---|---|---|---|---|---|---|---|---|---|---|---|---|---|
| type | C | Si | Mn | P | S | N | Al | Cu | Ni | Cr | Mo | W | Nb | V |
| A | 0.10 | 1.10 | 1.35 | 0.017 | 0.0033 | 0.0036 | 0.020 | | | | | | | |
| B | 0.06 | 0.22 | 1.10 | 0.018 | 0.0038 | 0.0040 | 0.020 | | | | | | | |
| C | 0.07 | 0.33 | 1.08 | 0.020 | 0.0033 | 0.0030 | 0.025 | | | | | | | |
| D | 0.14 | 1.43 | 1.54 | 0.029 | 0.0010 | 0.0040 | 0.025 | | | | | | | |
| E | 0.15 | 0.12 | 1.80 | 0.025 | 0.0014 | 0.0033 | 0.030 | | | | | | | |
| F | 0.20 | 1.20 | 2.51 | 0.025 | 0.0022 | 0.0033 | 0.010 | | | | 0.25 | | | |
| G | 0.15 | 0.81 | 2.52 | 0.025 | 0.0022 | 0.0033 | 0.011 | | | | | | | 0.11 |
| H | 0.22 | 0.31 | 2.20 | 0.025 | 0.0033 | 0.0040 | 0.011 | 0.15 | 0.05 | 0.03 | | 0.01 | | |
| I | 0.12 | 0.95 | 1.80 | 0.024 | 0.0031 | 0.0032 | 0.011 | | | | | | 0.022 | |
| J | 0.16 | 2.11 | 1.80 | 0.024 | 0.0112 | 0.0032 | 0.015 | | 0.25 | 0.75 | 0.03 | | | |

TABLE 1-2

| Steel | Chemical composition (mass %), balance: Fe and impurities | | | | | | | | | | | | |
|---|---|---|---|---|---|---|---|---|---|---|---|---|---|
| type | Ti | B | O | Ta | Co | Sn | Sb | As | Mg | Zr | Ca | REM | Remarks |
| A | | | 0.002 | | | | | | | | | | Invention steel |
| B | | | 0.003 | | | | | | | | | | Invention steel |
| C | | | 0.002 | | | | | | | | | | Invention steel |
| D | | | 0.002 | | | | | | | | | | Invention steel |
| E | | | 0.003 | | | | | | | | | | Invention steel |
| F | | | 0.002 | | | | | | | | | | Invention steel |
| G | | | 0.004 | | | | | | | | | | Invention steel |
| H | | | 0.004 | 0.02 | 0.02 | 0.01 | 0.01 | | | | | | Invention steel |
| I | 0.11 | 0.0003 | 0.002 | | | | | 0.012 | 0.011 | 0.023 | 0.0029 | 0.0021 | Invention steel |
| J | | | +0.002 | | 0.32 | 0.02 | | | | | 0.0033 | 0.0025 | Invention steel |

TABLE 2-1

| Test no. | Steel type | Finish rolling completion temperature ° C. | Final stage rolling reduction % | Rolling load R ton | Average cooling speed CR1 ° C./s | CR2 ° C./s | ΔCR ° C./s | Formula 4 $t \times R^{0.5}/\Delta CR$ | Cooling stop temperature ° C. |
|---|---|---|---|---|---|---|---|---|---|
| 1 | A | 884 | 27 | 914 | 136 | 112 | 24 | 2.0 | 396 |
| 2 | A | 1043 | 30 | 844 | 150 | 75 | 75 | 0.9 | 158 |
| 3 | A | 909 | 20 | 965 | 122 | 93 | 29 | 2.5 | 286 |
| 4 | A | 1048 | 55 | 1705 | 138 | 94 | 44 | 0.9 | 323 |
| 5 | A | 877 | 48 | 1502 | 132 | 98 | 34 | 3.0 | 331 |
| 6 | B | 930 | 54 | 3100 | 151 | 101 | 50 | 2.9 | 428 |
| 7 | B | 938 | 26 | 1277 | 102 | 80 | 22 | 2.6 | 331 |
| 8 | B | 1049 | 46 | 1103 | 42 | 21 | 21 | 4.6 | 593 |
| 9 | B | 1001 | 31 | 860 | 135 | 88 | 47 | 3.7 | 460 |
| 10 | C | 890 | 31 | 1814 | 57 | 32 | 25 | 4.9 | 431 |
| 11 | C | 882 | 33 | 1239 | 80 | 54 | 26 | 2.7 | 571 |
| 12 | C | 929 | 28 | 1739 | 132 | 112 | 20 | 6.7 | 265 |
| 13 | C | 996 | 31 | 1071 | 38 | 30 | 8 | 13.1 | 284 |
| 14 | C | 1009 | 45 | 1791 | 60 | 39 | 21 | 5.2 | 577 |
| 15 | D | 957 | 44 | 758 | 134 | 85 | 49 | 1.6 | 371 |
| 16 | D | 877 | 50 | 860 | 125 | 94 | 31 | 3.7 | 219 |
| 17 | D | 1017 | 37 | 1965 | 106 | 99 | 7 | 24.7 | 343 |
| 18 | D | 947 | 26 | 1447 | 148 | 110 | 38 | 2.3 | 406 |
| 19 | E | 880 | 37 | 1074 | 45 | 35 | 10 | 7.5 | 276 |
| 20 | E | 1026 | 30 | 885 | 57 | 29 | 28 | 2.4 | 244 |
| 21 | F | 882 | 54 | 1502 | 42 | 98 | 56 | 1.5 | 533 |
| 22 | G | 996 | 31 | 1103 | 57 | 80 | 23 | 3.2 | 458 |
| 23 | H | 1017 | 28 | 1239 | 38 | 88 | 50 | 1.5 | 581 |
| 24 | I | 880 | 45 | 2620 | 85 | 54 | 31 | 4.3 | 560 |
| 25 | J | 947 | 50 | 1074 | 45 | 112 | 67 | 1.9 | 350 |

Underlines indicate outside preferred range.

TABLE 2-2

| Test no. | Tensile strength MPa | Sheet thickness "t" mm | Sheet width mm | Steel sheet structure α + B area % | α area % | B area % | M area % | Other area % | One end $TS_{W1}$ MPa | $\lambda_{W1}$ % | $\lambda_{E1}$ % |
|---|---|---|---|---|---|---|---|---|---|---|---|
| 1 | 1150 | 1.6 | 800 | 96 | 34 | 62 | 0 | 4 | 1252 | 45 | 65 |
| 2 | 1365 | 2.3 | 800 | 81 | 6 | 75 | 15 | 4 | 1365 | 59 | 53 |
| 3 | 1082 | 2.3 | 1200 | 77 | 9 | 58 | 8 | 15 | 1082 | 41 | 43 |
| 4 | 1044 | 1.0 | 1200 | 86 | 14 | 72 | 0 | 14 | 1109 | 47 | 40 |
| 5 | 1109 | 2.6 | 1200 | 88 | 10 | 78 | 0 | 12 | 1112 | 47 | 40 |
| 6 | 1097 | 2.6 | 1700 | 95 | 33 | 62 | 0 | 5 | 1097 | 41 | 34 |
| 7 | 1447 | 1.6 | 1200 | 84 | 13 | 71 | 0 | 16 | 1460 | 44 | 35 |
| 8 | 1141 | 2.9 | 900 | 100 | 68 | 32 | 0 | 0 | 1186 | 41 | 34 |
| 9 | 1170 | 6.0 | 900 | 100 | 27 | 73 | 0 | 0 | 1263 | 51 | 40 |
| 10 | 1170 | 2.9 | 1550 | 94 | 29 | 65 | 0 | 6 | 1199 | 53 | 47 |
| 11 | 1016 | 2.0 | 1550 | 100 | 75 | 25 | 0 | 0 | 1016 | 44 | 45 |
| 12 | 1106 | 3.2 | 1550 | 87 | 6 | 81 | 5 | 8 | 1353 | 50 | 43 |
| 13 | 1294 | 3.2 | 1100 | 71 | 6 | 65 | 12 | 17 | 1294 | 54 | 60 |
| 14 | 1125 | 2.6 | 1100 | 100 | 77 | 23 | 0 | 0 | 1125 | 55 | 48 |
| 15 | 1146 | 2.8 | 750 | 93 | 32 | 61 | 0 | 7 | 1337 | 49 | 41 |
| 16 | 994 | 3.9 | 800 | 72 | 4 | 68 | 13 | 15 | 994 | 53 | 51 |
| 17 | 1027 | 3.9 | 1300 | 87 | 25 | 62 | 0 | 13 | 1027 | 68 | 67 |
| 18 | 1135 | 2.3 | 1300 | 100 | 29 | 71 | 0 | 0 | 1188 | 68 | 58 |
| 19 | 1171 | 2.3 | 900 | 72 | 8 | 64 | 15 | 13 | 1171 | 67 | 55 |
| 20 | 1045 | 2.3 | 900 | 72 | 11 | 61 | 12 | 16 | 1238 | 58 | 49 |
| 21 | 1156 | 2.2 | 1100 | 81 | 5 | 76 | 0 | 19 | 1109 | 51 | 55 |
| 22 | 1026 | 2.2 | 1500 | 78 | 6 | 72 | 0 | 22 | 1186 | 44 | 44 |
| 23 | 1140 | 2.2 | 1200 | 85 | 5 | 80 | 0 | 15 | 1199 | 55 | 55 |
| 24 | 993 | 2.6 | 1700 | 92 | 4 | 88 | 0 | 8 | 1194 | 68 | 66 |
| 25 | 1147 | 3.9 | 1500 | 89 | 18 | 71 | 11 | 0 | 1125 | 68 | 44 |

| Test no. | Other end $TS_{W2}$ MPa | $\lambda_{W2}$ % | $\lambda_{E2}$ % | Center part $TS_C$ MPa | $\lambda_C$ % | Formula 1 | Formula 3 | Formula 2 | Evaluation | Remarks |
|---|---|---|---|---|---|---|---|---|---|---|
| 1 | 1150 | 47 | 67 | 1139 | 50 | −4 | 16 | 62 | Pass | Inv. ex. |
| 2 | 1365 | 41 | 36 | 1283 | 69 | −19 | −25 | 82 | Fail | Comp. ex. |
| 3 | 1239 | 49 | 43 | 1140 | 56 | −11 | −13 | 21 | Pass | Inv. ex. |
| 4 | 1044 | 55 | 62 | 1018 | 35 | 16 | 16 | 59 | Fail | Comp. ex. |
| 5 | 1109 | 69 | 62 | 1091 | 44 | 14 | 7 | 20 | Pass | Inv. ex. |

TABLE 2-2-continued

| | | | | | | | | | | |
|---|---|---|---|---|---|---|---|---|---|---|
| 6 | 1328 | 38 | 32 | 1142 | 62 | −23 | −29 | 71 | Fail | Comp. ex. |
| 7 | 1447 | 75 | 66 | 1380 | 52 | 8 | −2 | 74 | Pass | Inv. ex. |
| 8 | 1141 | 56 | 47 | 1156 | 52 | −4 | −11 | 8 | Pass | Inv. ex. |
| 9 | 1170 | 46 | 55 | 1144 | 32 | 17 | 16 | 73 | Fail | Comp. ex. |
| 10 | 1170 | 58 | 51 | 1107 | 49 | 7 | 0 | 78 | Pass | Inv. ex. |
| 11 | 1389 | 73 | 58 | 1272 | 56 | 3 | −4 | −70 | Pass | Inv. ex. |
| 12 | 1106 | 55 | 49 | 1204 | 59 | −7 | −13 | 26 | Pass | Inv. ex. |
| 13 | 1297 | 61 | 60 | 1223 | 41 | 17 | 19 | 73 | Fail | Comp. ex. |
| 14 | 1368 | 64 | 57 | 1300 | 45 | 15 | 7 | −54 | Pass | Inv. ex. |
| 15 | 1146 | 42 | 38 | 1057 | 63 | −18 | −24 | 185 | Fail | Comp. ex. |
| 16 | 1451 | 63 | 60 | 1262 | 69 | −11 | −14 | −40 | Pass | Inv. ex. |
| 17 | 1106 | 60 | 59 | 1040 | 46 | 18 | 17 | 27 | Fail | Comp. ex. |
| 18 | 1135 | 41 | 33 | 1084 | 61 | −7 | −16 | 78 | Pass | Inv. ex. |
| 19 | 1176 | 74 | 59 | 1107 | 63 | 8 | −6 | 67 | Pass | Inv. ex. |
| 20 | 1045 | 79 | 57 | 1139 | 69 | −1 | −16 | 3 | Pass | Inv. ex. |
| 21 | 1247 | 65 | 68 | 1140 | 45 | 13 | 17 | 38 | Pass | Inv. ex. |
| 22 | 1170 | 46 | 44 | 1142 | 52 | −7 | −8 | 36 | Pass | Inv. ex. |
| 23 | 1197 | 73 | 65 | 1144 | 76 | −12 | −16 | 54 | Pass | Inv. ex. |
| 24 | 1251 | 64 | 62 | 1272 | 55 | 11 | 9 | −50 | Pass | Inv. ex. |
| 25 | 1206 | 60 | 50 | 1212 | 63 | 1 | −16 | −47 | Pass | Inv. ex. |

Underlines indicate outside preferred range.

The characteristics of the obtained rolled steel sheets were measured and evaluated by the following methods:

[Tensile Strength]

The tensile strengths $TS_{W1}$, $TS_{W2}$, and $TS_C$ in Tables 2-1 and 2-2 were determined in the following way. First, No. 5 tensile test pieces of JIS Z2241: 2011 were taken at a ⅛ position of sheet width from the sheet width direction end part of either the work side or drive side of the hot rolled steel sheet toward the sheet width center part in a direction vertical to the rolling direction and on the same line, the sheet width center part, and, furthermore, the ⅞ position of the sheet width in directions perpendicular to the rolling direction. Next, using the obtained test pieces, tensile tests based on JIS Z2241: 2011 were performed and the tensile strengths (MPa) of the test pieces were found. The tensile tests were performed two times on different test pieces and the average values of the tensile strengths (MPa) of the ⅛ positions of sheet width from one end in the sheet width direction (drive side) and the other end at the opposite side (work side) and the sheet width center part were respectively determined as $TS_{W1}$, $TS_{W2}$, and $TS_C$. Further, the lower value among $TS_{W1}$ and $TS_{W2}$ was determined as the tensile strength of the hot rolled steel sheet.

[Hole Expansion Ratio]

The hole expansion ratios $\lambda_{W1}$, $\lambda_{W2}$, and $\lambda_C$ in Tables 2-1 and 2-2 were determined in the following way by hole expansion tests based on JIS Z2256: 2020. First, tensile test pieces were taken at a ⅛ position of sheet width from the sheet width direction end part of either the work side or drive side of the hot rolled steel sheet toward the sheet width center part in a direction vertical to the rolling direction and on the same line, the sheet width center part, and, furthermore, the ⅞ position of the sheet width. Next, at positions of the obtained test pieces corresponding to the sheet width ⅛ position, the sheet width center part, and the sheet width ⅞ position, diameter 10 mm circular holes (initial holes: hole diameter d0=10 mm) were punched under conditions giving a clearance of 12.5% and the burrs made to form at the die side. A vertex 600 conical punch was used to expand the initial holes until cracks passing through the sheet thickness formed. The hole diameters d1mm when the cracks formed were measured and the following formula was used to find the hole expansion ratios λ (%) of the test pieces. The hole expansion tests were performed five times on different test pieces and the average values of the hole expansion ratios (%) of the ⅛ positions of sheet width from one end in the sheet width direction (drive side) and the other end at the opposite side (work side) and the sheet width center part were respectively determined as $\lambda_{W1}$, $\lambda_{W2}$ and $\lambda_C$.

$$\lambda=100\times(d1-d0)/d0$$

The hole expansion ratios $\lambda_{E1}$ and $\lambda_{E2}$ were determined by performing hole expansion tests based on JIS Z2256: 2020 in the same way as explained above for the hole expansion ratios $\lambda_{W1}$ and $\lambda_{W2}$ except for obtaining the test pieces from positions of 75 mm from one end of the sheet width direction and the other end at the opposite side to the sheet width center part side instead of the ⅛ position and ⅞ position of the sheet width.

[Evaluation]

From each of the obtained hot rolled steel sheets, two lower arms were produced by press-forming as suspension parts of automobiles in the sheet width direction. Cases where the two lower arms could be produced without occurrence of cracking were evaluated as "passing" while cases where cracking occurred in even one were evaluated as "failing". The results are shown in Tables 2-1 and 2-2.

Referring to Tables 2-1 and 2-2, in Comparative Examples 2, 4, 13, and 17, the relationship between the rolling load R of the final rolling stand in the hot rolling step and the average cooling speed difference ΔCR between the sheet width center part and the sheet width ⅛ position at the cooling step did not satisfy formula 4, therefore formula 1 was not satisfied and as a result cracks formed when producing the lower arms by press-forming. In Comparative Examples 6, 9, and 15, the rolling load R and sheet thickness were not suitable, therefore formula 1 was not satisfied and as a result cracks formed when producing the lower arms by press-forming. In contrast to this, in the hot rolled steel sheets of the invention examples, the sheet thickness and the sheet width were made suitable ranges while the hole expansion ratio measured in the sheet width direction satisfied the relationship of formula 1, therefore even with complicated shape parts like lower arms, it was possible to suppress the occurrence of cracking and produce the parts with a good yield. In addition, the hot rolled steel sheets of Invention Examples 3, 5, 7, 8, 10 to 12, 14, 16, 19, 22, and 24 produced by controlling formula 4 to 2.5 to 7.5 in range (i.e., produced so as to satisfy formula 5) satisfied formula 3, i.e., $-15\leq(\lambda_{E1}+\lambda_{E2})/2-\lambda_C\leq15$, therefore it will be understood that the hole expansion characteristic was made uniform up to regions closer to end parts in the sheet width direction and that this was extremely useful from the viewpoint of the yield.

The invention claimed is:

1. A hot rolled steel sheet having a tensile strength of 980 MPa or more, a sheet thickness of 1.2 to 4.0 mm, and a sheet width of 750 mm or more, and satisfying the following formula 1:

$$-15 \leq (\lambda_{W1}+\lambda_{W2})/2-\lambda_C \leq 15 \quad \text{formula 1}$$

where $\lambda_{W1}$ and $\lambda_{W2}$ respectively indicate hole expansion ratios (%) at ⅛ positions of the sheet width from one end of the hot rolled steel sheet in a sheet width direction perpendicular to a rolling direction and the other end at an opposite side, $\lambda_C$ indicates a hole expansion ratio (%) of a sheet width center part, and $\lambda_{W1}$, $\lambda_{W2}$, and $\lambda_C$ are respectively 40% or more, wherein the hot rolled steel sheet has a chemical composition comprising, by mass %, C: 0.01 to 0.50%,
Si: 0.01 to 3.50%,
Mn: 0.20 to 3.00%,
P: 0.100% or less,
S: 0.0200% or less,
N: 0.0100% or less,
Al: 0.001 to 1.000%,
Cu: 0 to 1.00%,
Ni: 0 to 0.50%,
Cr: 0 to 2.00%,
Mo: 0 to 3.00%,
W: 0 to 0.10%,
Nb: 0 to 0.060%,
V: 0 to 1.00%,
Ti: 0 to 0.20%,
B: 0 to 0.0040%,
O: 0 to 0.020%,
Ta: 0 to 0.10%,
Co: 0 to 3.00%,
Sn: 0 to 1.00%,
Sb: 0 to 0.50%,
As: 0 to 0.050%,
Mg: 0 to 0.050%,
Zr: 0 to 0.050%,
Ca: 0 to 0.0500%,
REM: 0 to 0.0500%, and
balance: Fe and impurities.

2. The hot rolled steel sheet according to claim 1, further satisfying the following formula 2:

$$-80 \leq (TS_{W1}+TS_{W2})/2-TS_C \leq 80 \quad \text{formula 2}$$

where $TS_{W1}$ and $TS_{W2}$ respectively indicate tensile strengths (MPa) at ⅛ positions of the sheet width from one end of the hot rolled steel sheet in a sheet width direction perpendicular to a rolling direction and the other end at an opposite side, and $TS_C$ indicates a tensile strength (MPa) of a sheet width center part.

3. The hot rolled steel sheet according to claim 1, further satisfying the following formula 3:

$$-15 \leq (\lambda_{E1}+\lambda_{E2})/2-\lambda_C \leq 15 \quad \text{formula 3}$$

where $\lambda_{E1}$ and $\lambda_{E2}$ respectively indicate hole expansion ratios (%) at positions of 75 mm to a sheet width center part side from one end of the hot rolled steel sheet in a sheet width direction perpendicular to a rolling direction and the other end at an opposite side, and $\lambda_C$ indicates a hole expansion ratio (%) of a sheet width center part.

4. The hot rolled steel sheet according to claim 1, wherein the sheet width is 750 to 1600 mm.

5. The hot rolled steel sheet according to claim 1, wherein the chemical composition comprises, by mass %, at least one of:

Cu: 0.001 to 1.00%,
Ni: 0.001 to 0.50%,
Cr: 0.001 to 2.00%,
Mo: 0.001 to 3.00%,
W: 0.001 to 0.10%,
Nb: 0.001 to 0.060%,
V: 0.001 to 1.00%,
Ti: 0.001 to 0.20%,
B: 0.0001 to 0.0040%,
O: 0.0001 to 0.020%,
Ta: 0.001 to 0.10%,
Co: 0.001 to 3.00%,
Sn: 0.001 to 1.00%,
Sb: 0.001 to 0.50%,
As: 0.001 to 0.050%,
Mg: 0.0001 to 0.050%,
Zr: 0.0001 to 0.050%,
Ca: 0.0001 to 0.0500%, and
REM: 0.0001 to 0.0500%.

6. The hot rolled steel sheet according to claim 1, wherein the content of Mo is 0.03% or less.

7. The hot rolled steel sheet according to claim 1, wherein the content of V is 0.11% or less.

* * * * *